United States Patent [19]

Labombarde

[11] Patent Number: 4,544,368

[45] Date of Patent: Oct. 1, 1985

[54] CASE PRESENTER APPARATUS AND METHOD

[76] Inventor: Raymond A. Labombarde, Daniel Webster Hwy. South, Nashua, N.H. 03061

[21] Appl. No.: 608,730

[22] Filed: May 10, 1984

[51] Int. Cl.[4] ..... B31B 1/54; B31B 3/02

[52] U.S. Cl. ..... 493/27; 493/183

[58] Field of Search ..... 493/162, 177, 180, 182, 493/183, 416, 436, 438, 446, 447, 448, 453, 456, 458, 27, 84, 70, 80; 53/458, 468, 381 R, 566

[56] References Cited

U.S. PATENT DOCUMENTS 3,388,641 6/1968 Gobel ..... 493/177

4,275,644 6/1981 Moss ..... 493/183

*Primary Examiner*—Husar Francis S.

*Assistant Examiner*—Robert L. Showalter

*Attorney, Agent, or Firm*—Pearson & Pearson

[57] ABSTRACT

An apparatus and method for repeatedly presenting a single, flat, tubular corrugated case, with its leading closure flaps overfolded in open flap position for easy gripping, erection and placement in the case gripper of a case packer device includes the provision of a bottom feed magazine holding a stack of such flats and a plurality of lug chains for advancing each successive individual bottom-most flat through a gateway and along a path up to the operator station of the case packer. Upper folding hooks of exact dimension are arranged to over fold the leading upper, major and minor closure flaps of each successive flat, without contact with the corresponding lower flaps. The leading lower major and minor closure flaps are underfolded further along the path and hold down bars maintain the folds. Sensing means triggers the advance of another flat when the operator removes the flat presented at the operator station.

10 Claims, 7 Drawing Figures

CASE PRESENTER APPARATUS AND METHOD

BACKGROUND OF THE INVENTION

The case presenter of this invention is designed to permit a single operator to perform the functions required by the case packer device disclosed in the copending U.S. patent application, Ser. No. 583,640 filed by Raymond A. Labombarde and Robert A. Tremblay. As explained in that application, in the prior art it has been necessary and customary to provide several operators to handle the production of a high speed folder-gluer such as manufactured by The International Paper Box Machine Company of Nashua, N.H.

The folded and glued box blanks delivered by the apron of a stacker in shingled formation has required the operators to travel back and forth between open corrugated cases, each carrying such number of box or tray flats as can be grasped without dropping and manually inserting the lift into the case until a layer is formed, and until the packing case is full.

The above mentioned case packer device permits a single operator to grasp an entire counted slug of folded glued flats, slide the slug onto a compression table, compress the slug and slide it bodily into an open corrugated packing case, held in a case gripper, which automatically turns the case back onto its bottom, closes the bottom flaps and discharges the case to a box taper.

To accomplish such efficient handling by a single operator, it is clear that the operator could not have a plurality of open, erected corrugated cases cluttering up the work area. Also, that the operator does not have time, or space, to repeatedly move around to the opposite side of the stacker apron to erect, or open, or position, a corrugated case ready for filling and then move back again to the near side to fill the case.

SUMMARY OF THIS INVENTION

It is for the above mentioned reasons that the invention of this application has been conceived, to enable a single operator to remain at one station, on one side of the packing apparatus and simply reach around, grasp, by the corners, a flat tubular corrugated case, presented at a convenient height, within easy reach, with the leading flaps open and overfolded. In one motion the inward pressure on the corners erects the case into an open tube so that it can be slidably inserted in the guides of the case gripper, for subsequent automatic handling by the case packer device while the operator can be grasping and sliding one or more slugs of flats into the open case.

Many more time delaying motions would be required of the operator, if it was necessary to pick a flat tubular corrugated case off a stack, attempt to overfold the four leading flaps with only two hands and hold them folded while erecting the tube and seeking to insert it in a case gripper. By having the leading flaps already overfolded, when each case is presented to the operator, the operators hand on one of the two corners,can hold the flaps open and folded as the case is erected and inserted in the case gripper.

DESCRIPTION OF A PREFERRED EMBODIMENT

Figure 1:
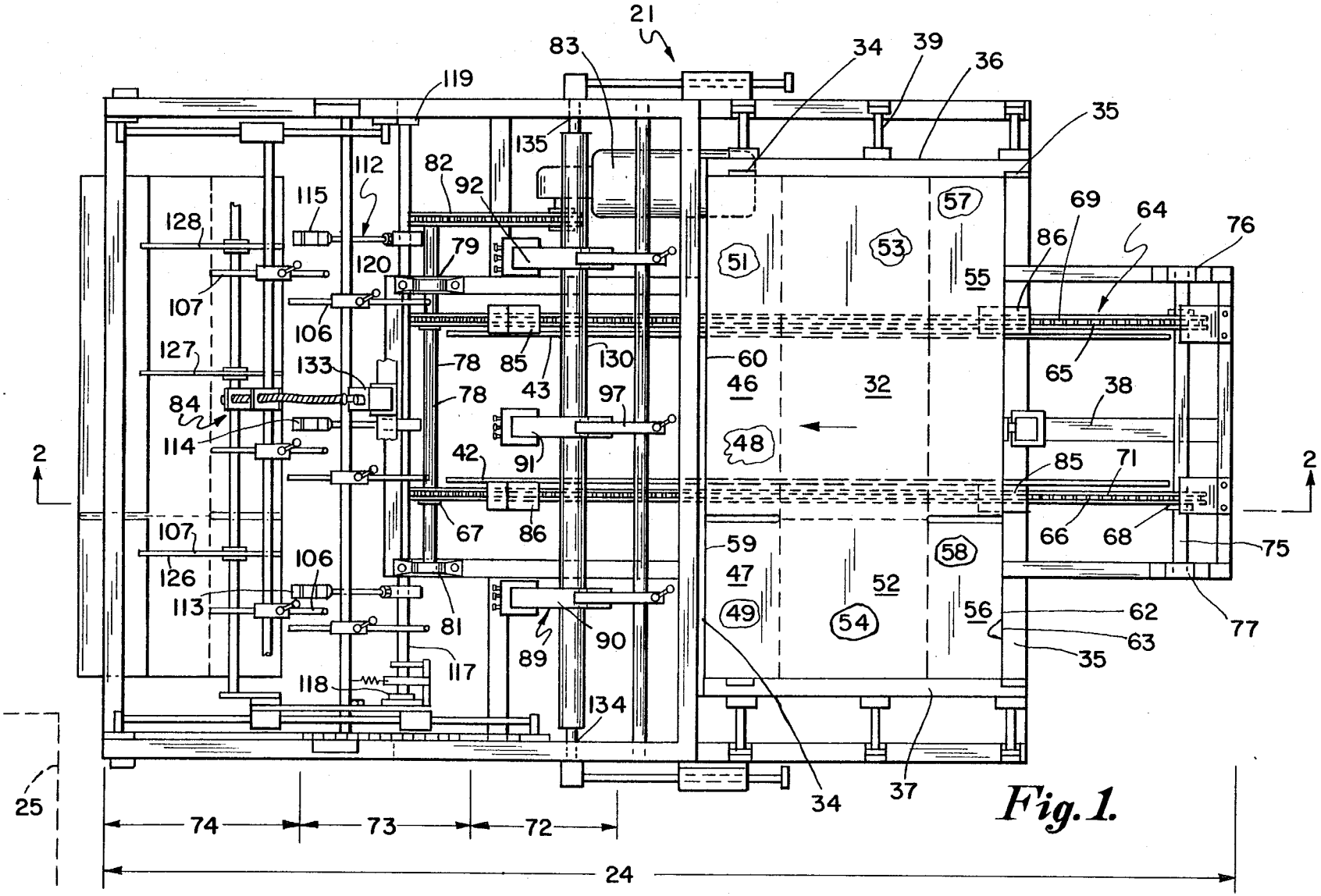
FIG. 1, is a top plan view.
Figure 2:
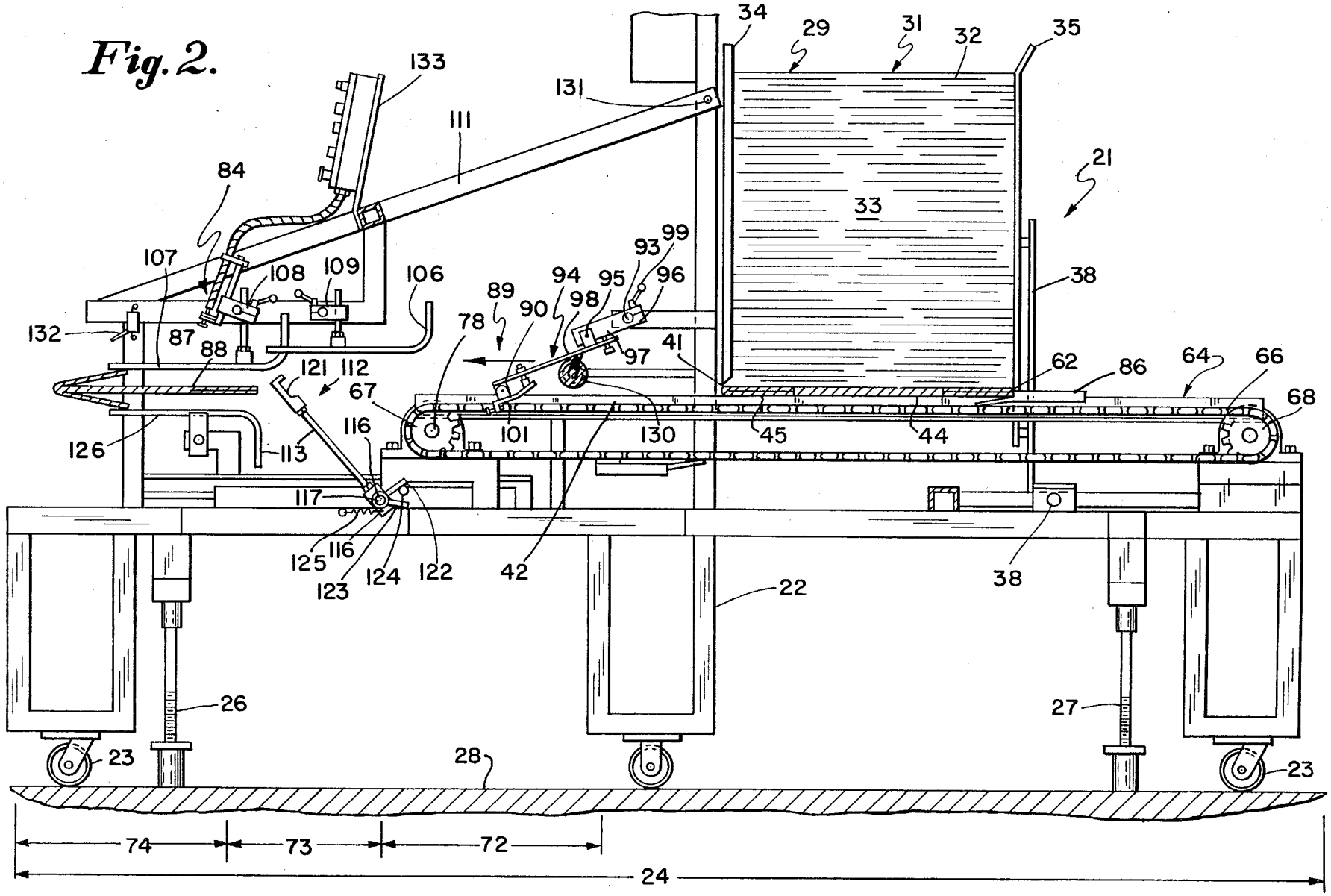
FIG. 2, is a side elevation of the case presenter apparatus of the invention, in section on line 2—2 of FIG. 1.
Figure 3:
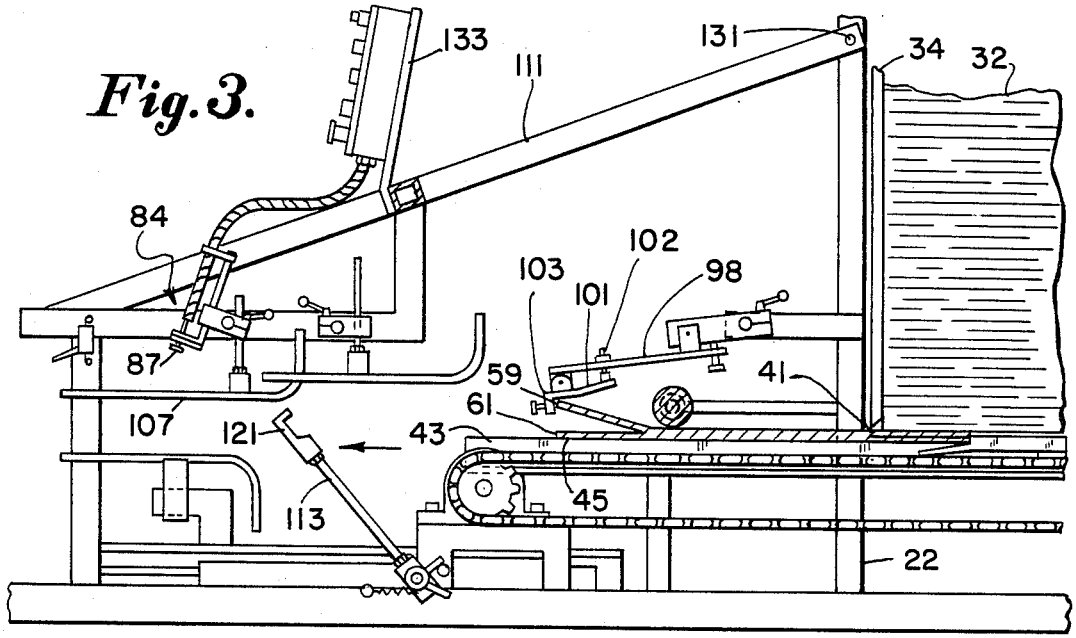
FIG. 3, is a view similar to FIG. 2 showing the overfolding of the upper flaps.
Figure 4:
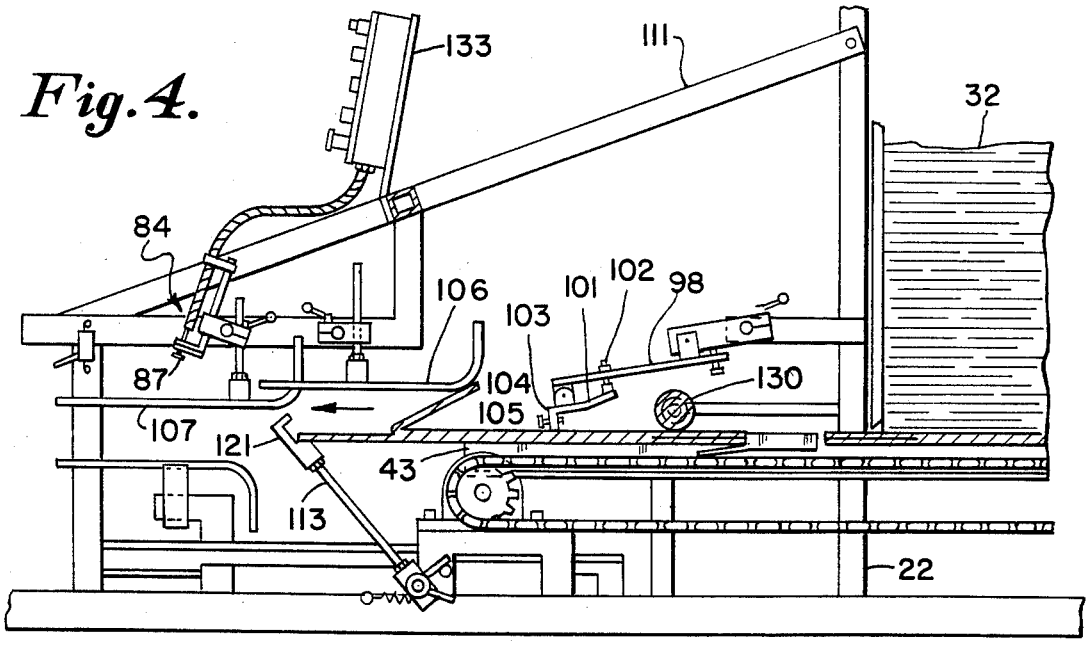
FIG. 4, and FIG. 5 are similar views showing the overfolding of the lower flaps.
Figure 5:
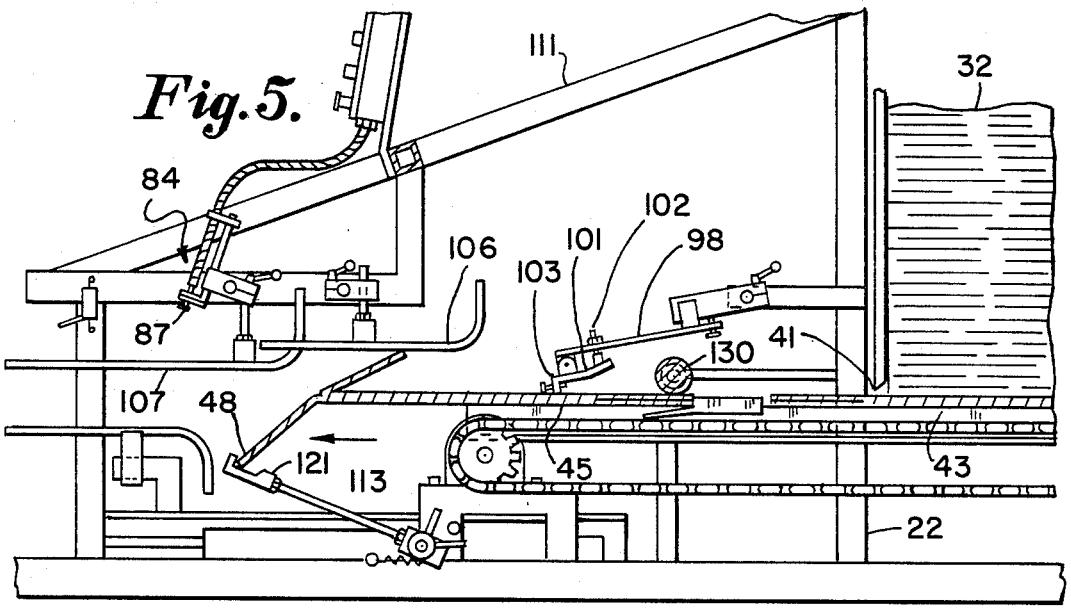
Figure 6:
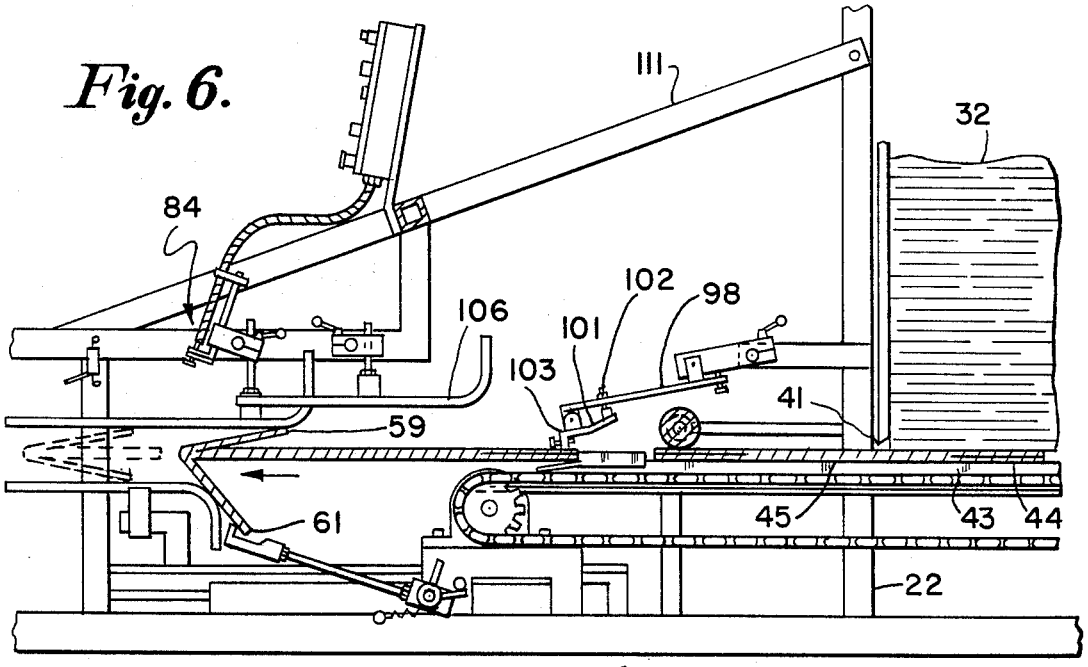
FIG. 6, is a similar view showing a flat in dotted lines, ready to be grasped by an operator.

As shown in the drawings, the case presenter apparatus 21 of the invention includes a main frame 22, mounted on wheels such as 23, for movement to a desired location 24, next to the operator station 25, for a single operator handling the operation of the case packer of the above mentioned U.S. patent application, Ser. No. 583,640, filed Feb. 27, 1984. A set of jacks such as 26 and 27 are provided for fixing the apparatus 21 at the correct location 24, within easy reach of the operator, on the floor 28, and for raising, or lowering, the apparatus to the correct height relative to the height of the operator, which is usually waist height.

Magazine means 29, includes the magazine 31, for holding a plurality of flat, tubular, corrugated cases 32 in a vertical stack 33, confined by the front wall 34, rear wall 35, and side wall 36, equal in height to the height of the stack, and a fourth, lower side wall 37 which enables a resupply of flat cases to be placed in the magazine 31 from the side. The walls 35, 36, and 37 are movable inwardly and outwardly, and clampable in position to hold flat cases of various dimensions as shown at 38 and 39. A gateway 41 is formed at the bottom of front wall 34, which will pass only one flat tubular corrugated case at a time, the bottom of the gateway 41 being formed by the longitudinally extending horizontal bars 42 and 43, which support the lower face 44 of each successive bottom most case 32 in the stack 33, as it advanced through the gateway 41 and along the horizontal path 45 toward the station 25.

Figure 7:
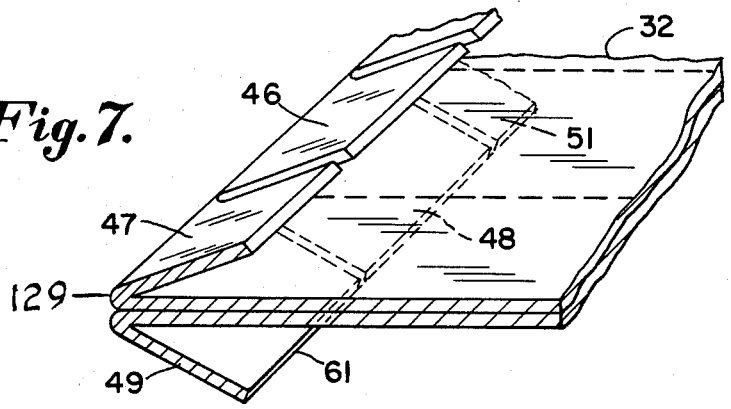
FIG. 7, is a perspective view of a flat, tubular, corrugated packing case.

As best shown in FIG. 7, each flat, tubular, corrugated case 32 includes leading upper major closure flap 46, leading upper minor closure flap 47 overlying leading lower major closure flap 48, and leading lower minor closure flap 49. It also includes corresponding major and minor side and end wall panels 51, 52, 53, and 54 and trailing upper and lower major and minor closure flaps 55, 56, 57, and 58 as well as leading upper and lower edges 59 and 61, and trailing upper and lower edges 62 and 63. Each case 32 is also of predetermined thickness of corrugated, so that when advancing along path 45 it is of double such thickness due to the overlying flaps and panels of each flat tubular case.

Bottom feed mechanism 64 is included in magazine means 29, the mechanism 64 comprising a pair of laterally spaced apart, longitudinally extending chains 65 and 66, trained around sprockets such as 67 and 68. The upper stretches 69 and 71 of chains 65 and 66 extend along the horizontal path 45 from in rear of magazine 31, along the bottom of the magazine, through gateway 41, through an upper flap folding zone 72, a lower flap folding zone 73 to the case presentation zone 74, alongside the operator station 25. Each sprocket 68 of each chain is rotatable on a shaft 75 journalled in bearings 76 and 77 supported on main frame 22, and each sprocket 67 is fastened on a shaft 78 journalled in bearings 79 and 81 supported on main frame 22. As shown in FIG. 1, shaft 78 is driven by a power train 82, from a motor 83, the motor being energized in response to the signals of sensing means 84.

A plurality of push lugs such as 85 and 86, are spaced around the chains 65 and 66, each arranged to engage the trailing edges 62 and 63 of the major and minor trailing flaps of each individual and successive bottom-most flat corrugated, tubular case 32, in magazine 31, and push the case through the gateway 41, and along the path 45, to the presentation zone 74, where it is halted by intercepting the beam from the photocell 87 of sensing means 84. The beam from photocell 87 is directed downwardly toward the upper face 88 of each case and the beam is reflected back therefrom to the cell to halt the bottom feed mechanism 64 until the operator has removed the case, whereupon absence of a case triggers the mechanism to respond by advancing the next successive bottom-most case in the stack 33.

The upper folding means 89 includes a plurality of upper folding hook assemblies such as 90, 91, and 92, pivotally mounted at 93, above path 45, in the upper flap folding zone 72, downstream from magazine 31, each upper folding hook assembly comprising an elongated straight element 94, pivoted at 95, intermediate of its length to an adjustable clamp 96 on main frame 22 to form a short arm 97 and a long arm 98. The short arm 97 includes a set screw 99, for varying the angle relative to the clamp 96, and the long arm includes an angular fold member 101, mounted at the end thereof and having a set screw 102 for adjustment of angle relative to long arm 98, and having a downwardly directed short element 103, constituting the upper fold hook of predetermined length of the invention.

The short element 103, includes a set screw 104, and is of predetermined length equal to the thickness of the corrugated material 105, so that it intercepts the leading edges 59 and 60 of the upper major closure flap 46, and upper minor closure flap 47, without intercepting the leading edges 61, of the lower leading major and minor closure flaps 48 and 49. Thus, the leading upper major and minor closure flaps are overfolded in upper folding zone 72, into open position and held in that position by upper hold down bars such as 106 and 107, which are mounted by clamps such as 108 and 109, on sub-frame 111.

Lower folding means 112, is provided in lower flap folding zone 73, comprising a plurality of lower folding hooks such as 113, 114, and 115, each pivoted as at 116, to a transverse shaft 117 mounted in blocks 118 and 119 arranged for longitudinal adjustment relative to main frame 22, so that the hooked portions such as 121, of each hook are correctly positioned to underfold the leading lower major and minor closure flaps 48 and 49 of each successive individual case 32, advanced through zone 73, along path 45. Limit arms 122, and 123, and a stop 124, limit the arc of movement of the lower folding hooks, there being a return spring 125, to return each hook to position after underfold of the lower flaps.

Lower hold down bars 126, 127, and 128 maintain the lower leading flaps in open, folded condition in the presentation station 25, ready for the operator to grasp the corners of the case, remove and erect it into a tube and insert it into the case gripper of a case packer device.

The lower folding means 112, is downstream of the upper folding means 89, and the upper folding means 89 preferably includes a hold down roller 130, extending laterally above the path 45, downstream of magazine 31, and upstream of the upper fold hook means 89. Roller 130, is journalled in bearings 134 and 135, each on an opposite side of main frame 22, the bearings being longitudinally movable to position the roller just in rear of the fold line 129 of the leading upper major and minor closure flaps as they are contacted and upfolded by the fold hooks 103. Thus, an exact fold on the fold line is assured by causing the flaps to first bow and then bend on the predetermined fold line.

The sub-frame 111 is pivoted at 131, to main frame 22, and connected at the front thereto by the quick release latch 132, so that it can be raised with the sensing means 84, control box 133, and upper hold down bars 106 and 107, and clamps 108 and 109 to give access to the fold hooks, adjustable gateway 41, and other parts for a new run of flat cases of different dimensions.

I claim:

1. Apparatus for presenting a single, flat, corrugated case, to an operator station of a case packer device, for erection and insertion in a case gripper, said apparatus comprising:

a magazine for holding a plurality of said cases in a stack;

said magazine having a bottom feed mechanism for advancing each bottom-most flat case in said stack, individually and successively along a path extending from said magazine to said station, with the leading upper major and minor closure flaps superposed on the leading lower major and minor closure flaps;

a plurality of upper folding hooks pivotally mounted above said path downstream of said magazine, the hooks thereof being of predetermined length about equal to the thickness of the corrugated so as to overfold said leading upper major and minor closure flaps without engaging the leading lower major and minor closure flaps;

a plurality of lower folding hooks pivotally mounted below said path, downstream of said upper folding hooks, the hooks thereof being located to underfold said leading lower major and minor closure flaps;

upper hold down bars, above said path, and lower hold down bars, below said path, for holding said flaps in open, folded position downstream of said folding hooks along said path;

and sensing means upstream of said operation station, responsive to the arrival of each successive individual folded case for halting said bottom feed mechanism until the case is removed by the operator and then recycling said mechanism to advance the next successive flat case in said stack along said path.

2. Apparatus as specified in claim 1 wherein:

said magazine includes a plurality of upstanding side walls of substantial height, arranged to form a three sided receptacle for a relatively high stack of corrugated flats, the fourth wall being relatively low to permit the easy insertion of a resupply of flats.

3. Apparatus as specified in claim 1 wherein:

said magazine, bottom feed mechanism, fold hooks, hold down bars and sensor are all mounted, on a wheeled frame which positions said path at about waist length, so that each successive individual, open, folded corrugated case is presented at a convenient height to the operator.

4. Apparatus as specified in claim 1: plus a hold down roller extending laterally, above said path, downstream of said magazine and upstream of said upper folding hooks, said roller riding on the upper surface of each successive case advancing along said path and positioned relative to said upper folding hooks to press down on said upper surface just behind the fold line upon which said upper closure flaps are being upfolded by said hooks to assure a correct fold.

5. Apparatus as specified in claim 1 wherein:

said bottom feed mechanism includes a gateway in said magazine sized to pass only one corrugated case at a time, an endless chain having an upper stretch extending along the bottom of said magazine and gateway, and along said path up to said station and a plurality of push lugs spaced around said chain and arranged to push on the trailing edges of each bottom-most case in said stack to advance the case through said passageway and along said path.

6. Apparatus as specified in claim 1, wherein:

said magazine, said bottom feed mechanism, said upper and lower folding hooks, and said lower hold down bar are all mounted on a main frame and;

said upper hold down bars and said sensor are mounted on a sub-frame pivotally mounted at the rear to said main frame and connected at the front by a quick release latch to said main frame;

whereby said sub-frame can be raised to provide access to the folding hooks for adjustment thereof.

7. Apparatus as specified in claim 1 wherein:

said sensing means is a photocell mounted on said sub-frame and directing a beam downwardly toward the upper face of a flat case delivered to said operator station by said bottom feed mechanism for reflection back to said cell from said face, absence of such reflection triggering said bottom feed mechanism to advance the next successive bottom most flat case in said stack along said path up to said station to intercept said beam.

8. Apparatus as specified in claim 1 wherein:

each said upper folding hook includes an elongated straight element pivoted intermediate of the length thereof, to an adjustable clamp on said main frame, to form a short arm and a long arm, the short arm having a set screw for varying the angle relative to said clamp and the long arm having an angular fold member pivotally mounted at the end thereof, said member having an elongated rearwardly directed element carrying a set screw for adjustment relative to said long arm and having a downwardly directed short element constituting said fold hook of predetermined length.

9. Apparatus for presenting a plurality of flat corrugated cases individually and successively to the operator station of a case packer with the leading major and minor flaps overfolded rearwardly ready for gripping and erection into a tube by the operator, said apparatus comprising:

a frame having a bottom feed magazine, an upper flap folding zone and a lower flap folding zone arranged in serial order, said bottom feed magazine having means for advancing each successive bottom-most flat case, of a stack of flat cases in the magazine, individually and successively along a substantially horizontal path through said upper flap folding zone and said lower flap folding zone to said operator station;

upper folding means, in said upper flap folding zone for overfolding the leading upper major and minor flaps of each case into over folded condition;

lower folding means in said lower flap folding zone for underfolding the leading lower major and minor flaps of each case into over folded condition;

hold down means along said path for holding said flaps in over folded condition; and sensing means at the end of said path proximate said operator station for halting each successive case arriving at said station, until removed therefrom and then actuating said magazine means to advance the next successive case along said path.

10. The method of presenting a plurality of flat, tubular, corrugated cases to the operator station of a case packer with the leading flaps overfolded ready for erection and insertion into a case gripper, by means of a bottom feed magazine, upper folding means, and lower folding means which comprises the steps of:

feeding a plurality of flat, tubular corrugated cases, individually and successively from said magazine along a path up to said operator station;

overfolding the leading upper major and minor closure flaps of each case advancing along said path, downstream of said 12 magazine, without overfolding the leading lower major and minor closure flaps thereof;

then under folding the leading lower major and minor closure flaps of each said case further downstream of said path;

holding down all of said overfolded flaps along said path;

and halting the feed of said flats while a flat is present ready for removal by an operator, but actuating said feed to deliver the next successive flat in said magazine, each time such removal occurs.

* * * * *